US011419775B2

(12) United States Patent
Derringer

(10) Patent No.: US 11,419,775 B2
(45) Date of Patent: Aug. 23, 2022

(54) WHEELCHAIR SAFETY DEVICE

(71) Applicant: Michael E. Derringer, Greenwood, IN (US)

(72) Inventor: Michael E. Derringer, Greenwood, IN (US)

( * ) Notice: Subject to any disclaimer, the term of this patent is extended or adjusted under 35 U.S.C. 154(b) by 373 days.

(21) Appl. No.: 16/729,591

(22) Filed: Dec. 30, 2019

(65) Prior Publication Data

US 2021/0196541 A1 Jul. 1, 2021

(51) Int. Cl.
*A61G 5/14* (2006.01)
*A61G 7/10* (2006.01)

(52) U.S. Cl.
CPC ..... *A61G 5/14* (2013.01); *A61G 7/1038* (2013.01)

(58) Field of Classification Search
CPC ..... A61G 5/14; A61G 7/1038
See application file for complete search history.

(56) References Cited

U.S. PATENT DOCUMENTS 2,441,997 A * 5/1948 Faulkner ..... A61G 5/14 482/68
2,556,121 A * 6/1951 Thomas ..... A61G 5/10 482/68
2,596,055 A * 5/1952 Thomas ..... A61G 5/14 482/68
3,398,974 A * 8/1968 Edwards ..... A61G 5/1054 297/5
3,584,890 A * 6/1971 Presty ..... A61G 5/14 482/68
3,719,390 A * 3/1973 Haney ..... A61G 5/1054 297/42
3,999,778 A * 12/1976 Markiel ..... A61H 3/04 280/43
5,419,571 A * 5/1995 Vaughan ..... A61G 5/1054 280/250.1
5,477,211 A * 12/1995 Reynolds ..... A61H 3/00 135/65
6,467,797 B1 * 10/2002 Lofy ..... A61H 3/04 280/647
8,998,244 B2 * 4/2015 Purdue ..... A61G 5/02 280/647
9,308,144 B2 * 4/2016 Derringer ..... A61G 5/1029
10,704,580 B2 * 7/2020 Bordenave ..... F16B 7/10

* cited by examiner

*Primary Examiner* — Jacob B Meyer
*Assistant Examiner* — Hosam Shabara
(74) *Attorney, Agent, or Firm* — Maginot, Moore & Beck, LLP

(57) ABSTRACT

A device that can be quickly and easily mounted on a wheelchair for assisting a wheelchair user to safely exit or enter a wheelchair that includes a support having a horizontal top rail, the top rail having a first end and a second end, a first leg depending downwardly from the first end, and a second leg arranged opposite and parallel to the first leg, the second leg depending downwardly from the second end. The device further includes a bracket attached to the wheelchair, the bracket is constructed to engage with a bottom of the first leg such that when the bracket and bottom of the first leg are engaged, the device may be used to enter or exit the wheelchair.

15 Claims, 13 Drawing Sheets

WHEELCHAIR SAFETY DEVICE

BACKGROUND

The present disclosure relates to safety devices to enhance the use of wheelchairs by minimizing or eliminating falls for wheelchair users. More particularly, the present disclosure relates to devices for assisting wheelchair users in safely exiting and entering their wheelchair.

Older adult falls are increasing and sadly often herald the end of independence. The CDC issued a report in 2018 estimating that there was a 42% increase in death by elderly falls from 2000-2006 and a 31% increase from 2007-2016. The fall injury cost to Medicare/Medicaid was $50 Billion in 2015. That number is estimated to reach nearly $68 Billion by 2020. Morbidity and Mortality Weekly Report—Weekly/May 11, 2018/67(18); 509-514.

Although the precise number of falls attributed to wheelchair use is not known, it is known that a significant portion of elderly falls is associated with wheelchair use. It is estimated that between 1.6 and 2.2 million Americans rely on wheelchairs to provide mobility on a daily basis. Wheelchair falls can result from unassisted transfers either into or out of the wheelchair. Sliding off and tipping are also common reasons for wheelchair falls. As wheelchair bound elderly persons attempt unassisted exit from or entry onto a wheelchair, their center mass of gravity often is not maintained. When they lose that center mass of gravity, a fall and/or tipping of the wheelchair with the person will often occur. In such cases, a wheelchair bound person simply does not have the strength to reacquire that mass center of gravity and associated balance and leverage.

Consequently, elderly bound wheelchair users typically need assistance in exiting and entering their wheelchairs. Assistance is not always available, so often the wheelchair bound individual is forced to either wait for assistance or attempt an exit on his or her own and risk falling.

What is needed in the art is a device that will assist a wheelchair bound person to safely exit or enter a wheelchair without assistance from another person or with less assistance from another person. Such a device would allow the wheelchair bound person to maintain his or her mass center of gravity, balance and leverage when exiting or entering a wheelchair. Consequently, use of such a device will reduce the fear of falling, reduce or eliminate actual falls, increase independence and improve the quality of life for the wheelchair user.

SUMMARY

In one embodiment of the disclosure a device for assisting a wheelchair user with exit from or entry onto a wheelchair is provided. The device includes a support having a horizontal top rail, the top rail having a first end and a second end, a first leg depending downwardly from the first end a second leg arranged opposite and parallel to the first leg, the second leg depending downwardly from the second end. The second leg may include an adjustable section for adjusting the height of the second leg. The device further includes a bracket attached to the wheelchair, the bracket constructed to engage with a bottom of the first leg such that when the bracket and bottom of the first leg are engaged, the device may be used to enter or exit the wheelchair. The device of may further comprise at least one support strut arranged below the top rail and extending between the first leg and the second leg.

Another embodiment of the present disclosure may include a support having a horizontal top rail, the top rail having a first end and a second end, a first leg depending downwardly from the first end a second leg arranged opposite and parallel to the first leg, the second leg depending downwardly from the second end. The second leg may include an adjustable section for adjusting the height of the second leg. The device further includes a bracket attached to the wheelchair, the bracket constructed to engage with a bottom of the first leg such that when the bracket and bottom of the first leg are engaged, the device may be used to enter or exit the wheelchair. The wheelchair may include a frame having at least one horizontal member and at least one vertical member and wherein the bracket is attached to the at least one horizontal member and the at least one vertical member. The device may further comprise a dual pin block fixedly attached to the first leg near the bottom, such that the bottom of the first leg extends below the dual pin block. The dual pin block may further include a pin extending below the dual pin block and parallel to the first leg. The bracket may include a first receiving feature and a second receiving feature, the first receiving feature constructed to receive the bottom of the first leg and the second receiving feature constructed to receive the pin. When the support is mounted on the bracket, the support is locked into a preferred position for exit from the wheelchair.

DETAILED DESCRIPTION

Figure 1:
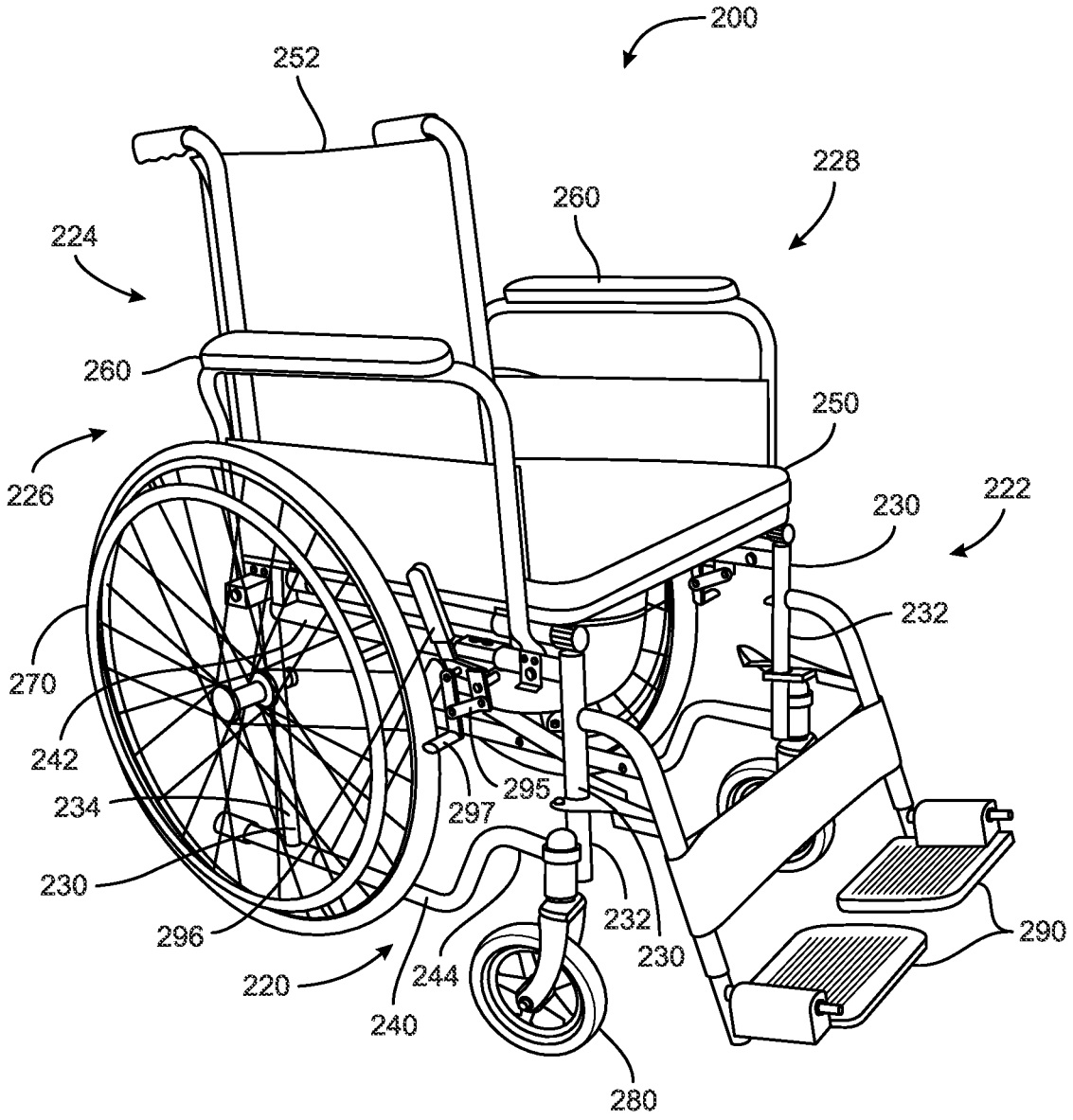
FIG. 1 PRIOR ART
FIG. 1 is a non-limiting perspective view of a prior art wheelchair.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

Referring to FIG. 1, a non-limiting embodiment of a typical wheelchair is depicted. A wheelchair 200 includes a frame 220 having a front 222, a back 224, a left side 226 and a right side 228. Attached to the frame is a seat 250 and a back support 252, each for supporting an occupant of the wheel chair 200. Also attached to the frame is a set of opposing arm rests 260 arranged above and on each side of the seat 250 along the left side 226 and right side 228.

Other features attached to the frame 220 include a set of opposing back wheels 270, one wheel arranged along the left side 226 and the second wheel arranged along the right side 228, and a set of opposing front wheels 280 arranged in front of the back wheels on the left and right side of frame 220 respectively. Typically, the back wheels 270 are significantly larger than the front wheels 280, but not always. Typically, foot rests 290 are attached to the front 222 of frame 220. One or more brakes 295 are typically attached to frame 220 and arranged to apply a braking force to back wheels 270. Brake 295 may include a brake handle 296 connected to a brake pad 297. The brake handle 296 may be used to force the brake pad 297 against back wheel 270, thus applying a braking force to back wheel 270. Handle 296 may be used to move brake pad 297 away from back wheel 270 to remove the braking force from back wheel 270.

Frame 220 typically includes multiple vertical members 230 that may include vertical members arranged near the front 222 of frame 220, which may be referred to as front vertical members 232. Vertical members 230 may also include vertical members arranged near the back 224 of frame 220, which may be referred to as back vertical members 234. Frame 220 may also include multiple horizontal members 240 that may include upper horizontal members 242 and lower horizontal members 244.

Figure 2:
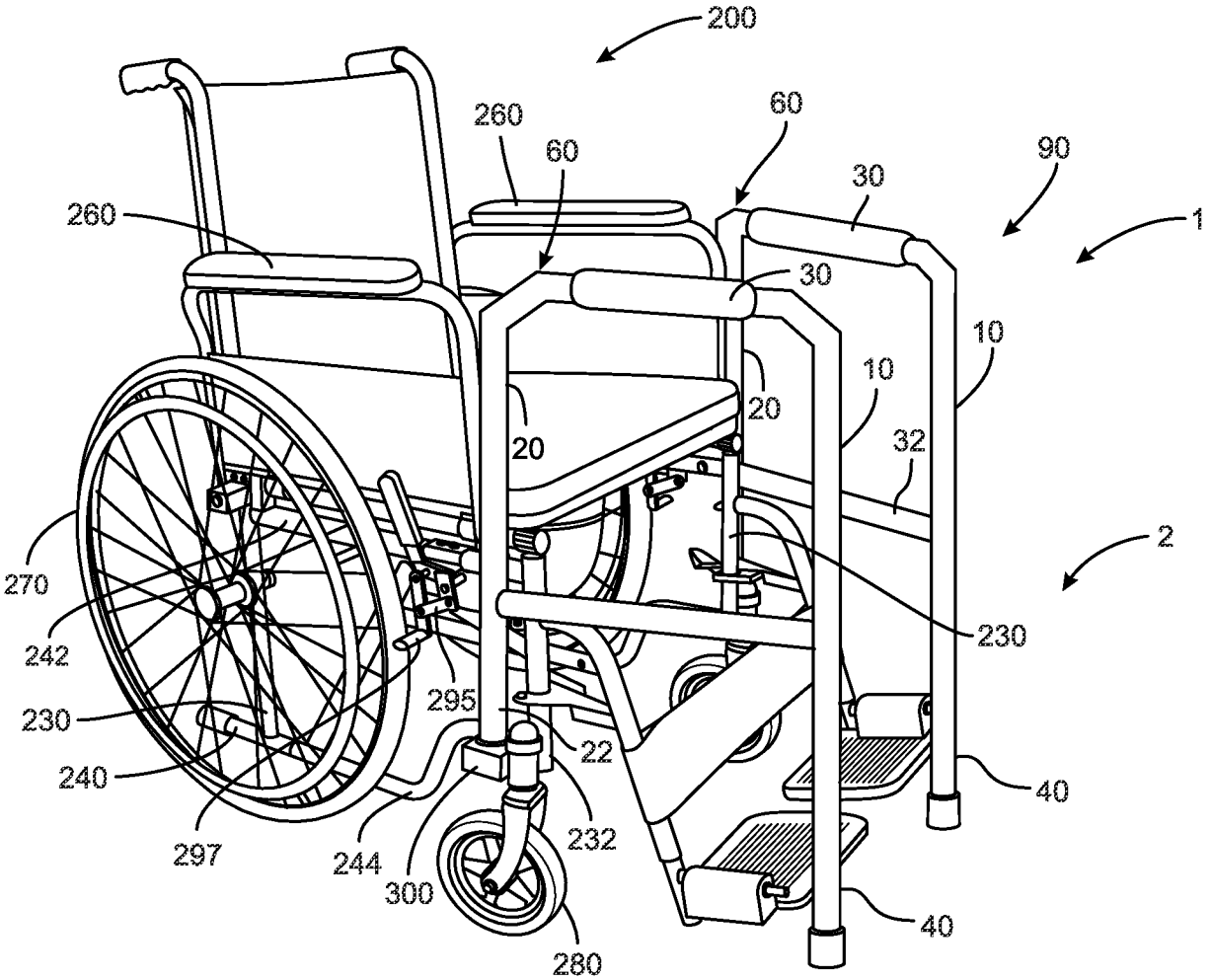
FIG. 2 is a non-limiting perspective view of according to one aspect of the present disclosure.
Figure 3:
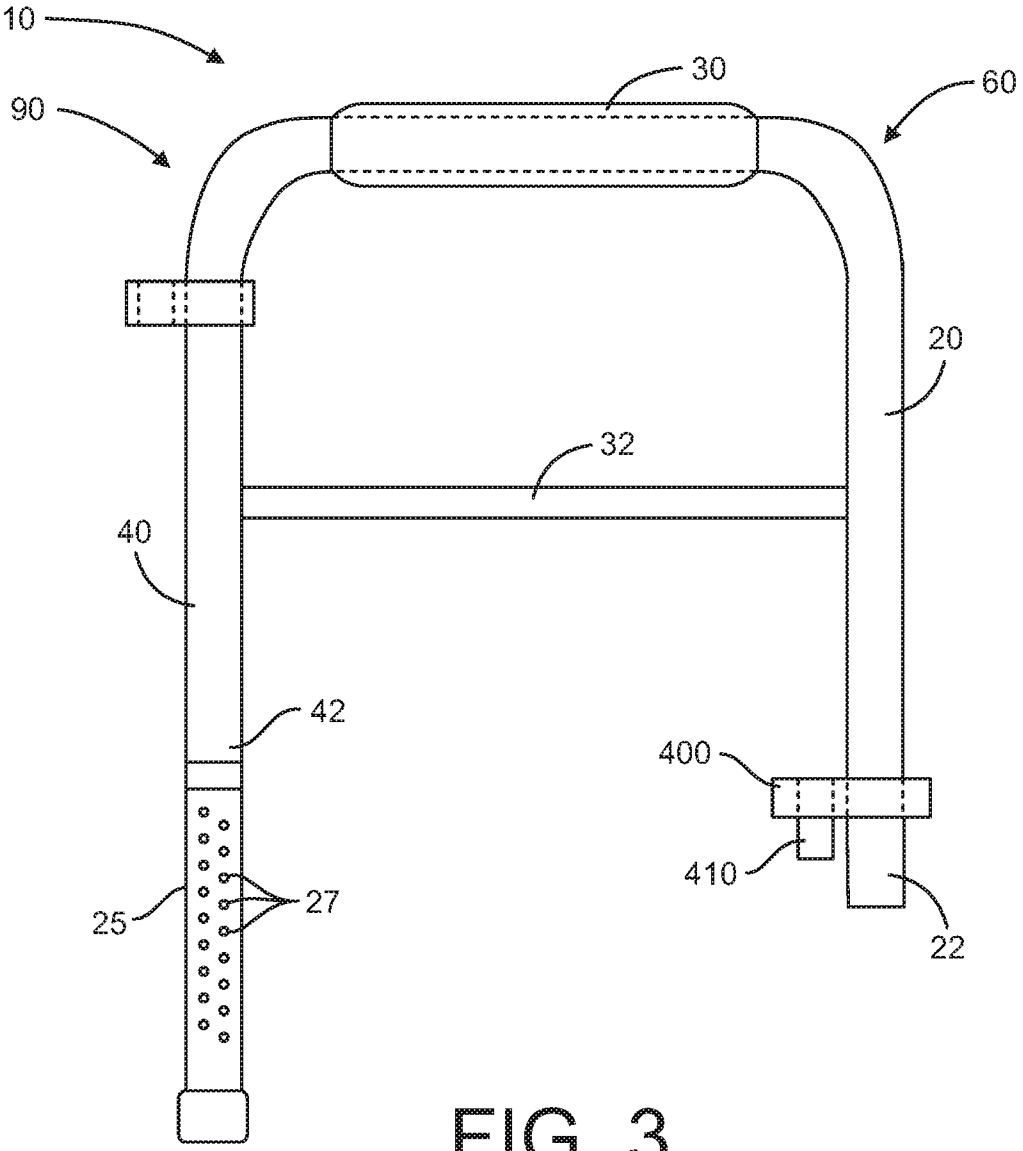
FIG. 3 is a non-limiting view according to one aspect of the present disclosure.

Now referring to FIG. 2 and FIG. 3, one embodiment of the present disclosure includes a device 1 for assisting a person with entry into and exit from a wheelchair 200. Typically, use of device 1 will include use of a second device 1, one such device extending from the front 222 on the left side 226 of wheelchair 200 and the other extending from the front 222 on the right side 228 of wheelchair 200. Device 1 may include a support 10 having a horizontal top rail 30. When device 1 is attached to wheelchair 200, horizontal top rail 30 may be located at a height at or near the height of arm rests 260 of wheelchair 200. The top rail 30 includes a first end 60 and an opposing second end 90. The first end 60 is located closer to the wheelchair 200 than second end 90 when the support 10 is mounted on the wheelchair.

Two supports 10 may be mounted on wheelchair 200, one extending from the front on the left side 226 of wheelchair 200 and one extending from the front 222 on the right side 228 of the wheelchair. As will be discussed in more detail below, supports 10 are mounted so as to be in a preferred position 2 for easy exit from and/or entry onto wheelchair 200. In the preferred position 2, first end 60 of each top rail 30 of support 10 is located closer to the wheelchair 200 and, more particularly, closer to the respective arm rests 260 than second end 90 of top rail 30. Stated differently, second end 90 of each top rail 30 extends away from wheelchair 200 when support 10 is mounted on wheelchair 200. Moreover, in the preferred position 2, each second end 90 of the respective top rails 30 of supports 10 are arranged such that the distance between each of the second ends 90 is less than the distance between the respective first ends 60 when the two supports 10 are mounted on wheelchair 200. In other words, when the supports are mounted on the wheelchair, the second ends 90 extend away from wheelchair 200 and are angled toward each other.

The preferred position 2 of support 10, when mounted on wheelchair 200, is designed to maintain the center mass of gravity of a person either exiting or entering the wheelchair 200. There are several advantages to the preferred position 2. For a person that uses a wheelchair, the support of the present disclosure in the preferred position when mounted on a wheelchair reduces or eliminates falls that often occur when entering or exiting a wheelchair by traditional means. For a wheelchair bound person, the support of the present disclosure reduces or eliminates the fear of falling when either entering or exiting a wheelchair because of the added control the person experiences using the device. This added feeling of control reduces or even eliminates in some cases the need for assistance when entering or exiting a wheelchair.

Consequently, assistance injuries that often occur when someone is assisting a wheelchair occupant may be reduced or eliminated. Another advantage of the device of the present disclosure includes reduction or elimination of the risk of wheelchair tipping often associated with traditional means of exiting and entering wheelchairs. The device of the present disclosure increases independence of wheelchair users and improves quality of life.

Support 10 also includes a first leg 20 having a proximal end extending downwardly from first end 60 of top rail 30. Arranged opposite the proximal end of first leg 20 is a bottom end 22 of first leg 20. Support 10 includes a second leg 40 arranged parallel to first leg 20 and extending downwardly from second end 90 of top rail 30. In some embodiments, second leg 40 may include a floor-stop height extension 25 that is constructed to engage with a bottom 42 of second leg 40. The floor-stop height extension 25 is constructed to be adjustable so that it may be extended from or retracted over or into bottom 42 of second leg 40.

Figure 4:
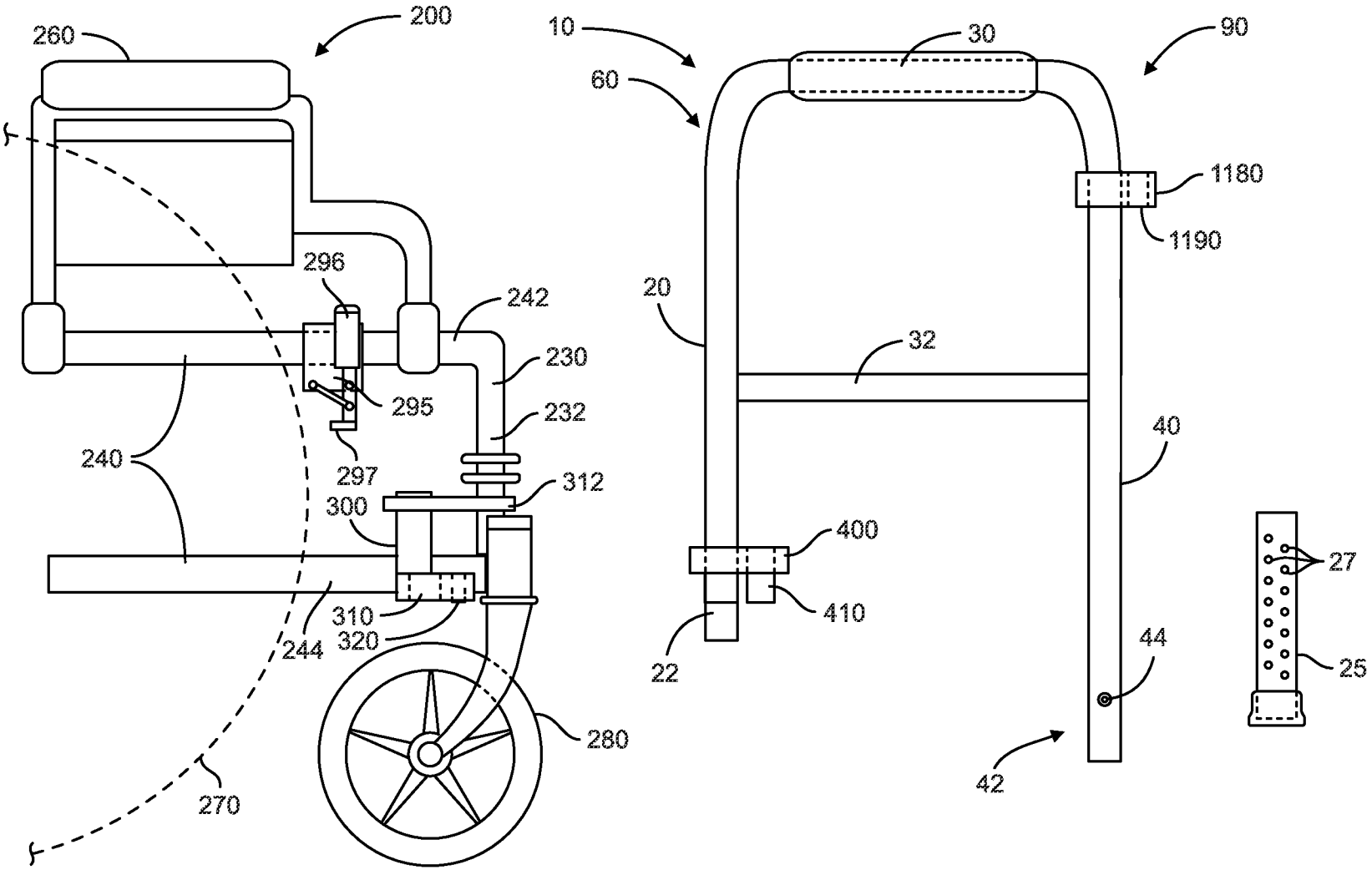
FIG. 4 is a non-limiting view according to one aspect of the present disclosure.
Figure 5:
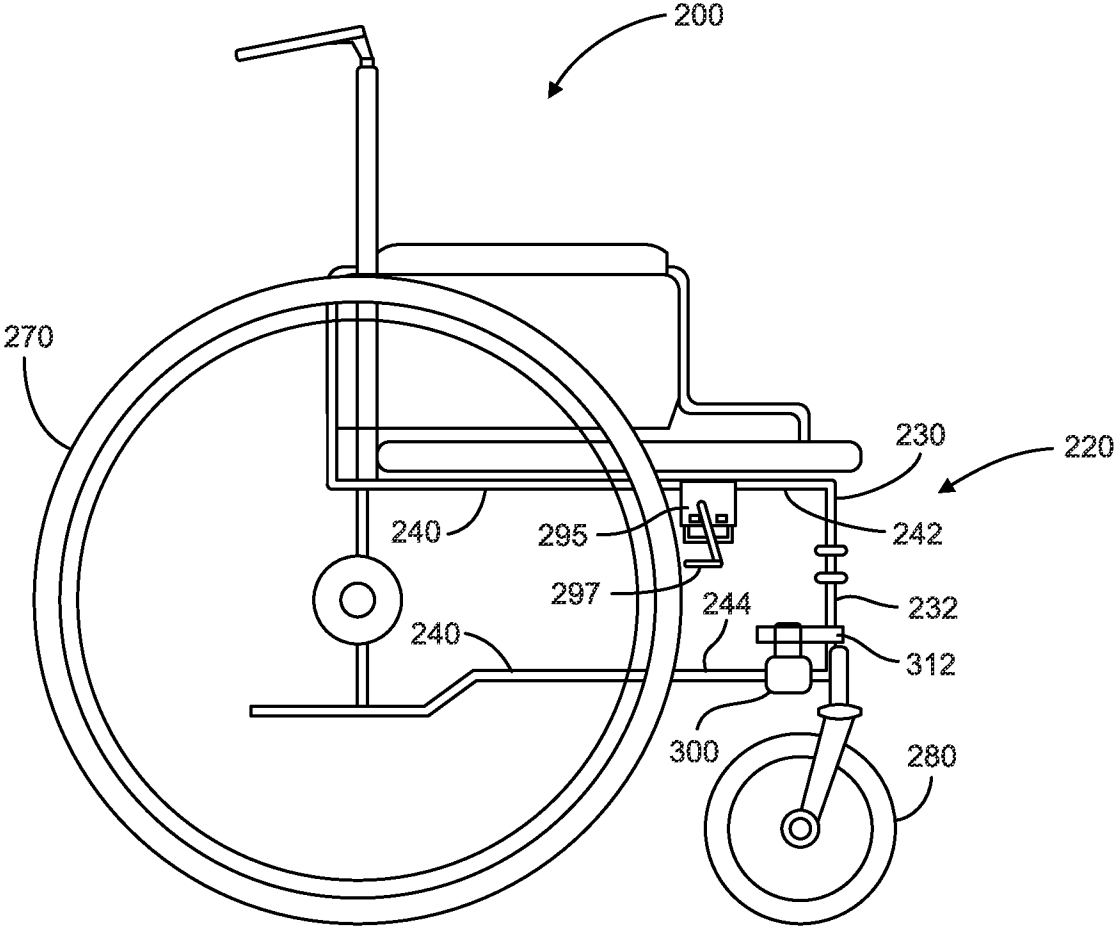
FIG. 5 is a non-limiting view according to one aspect of the present disclosure.
Figure 6A:
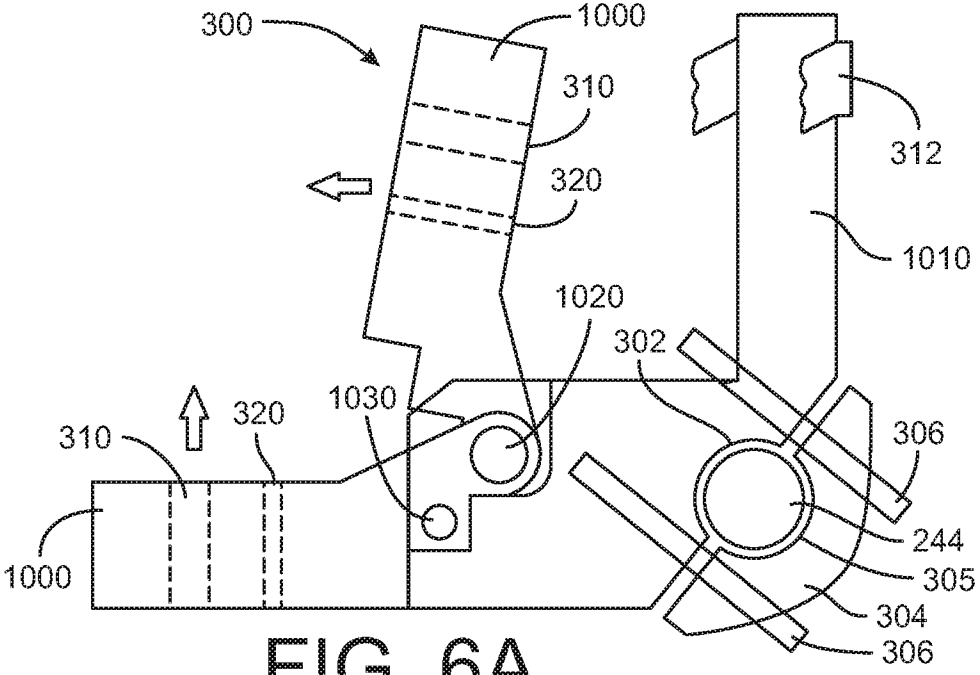
FIG. 6A is a non-limiting side view according to one aspect of the present disclosure.
Figure 6B:
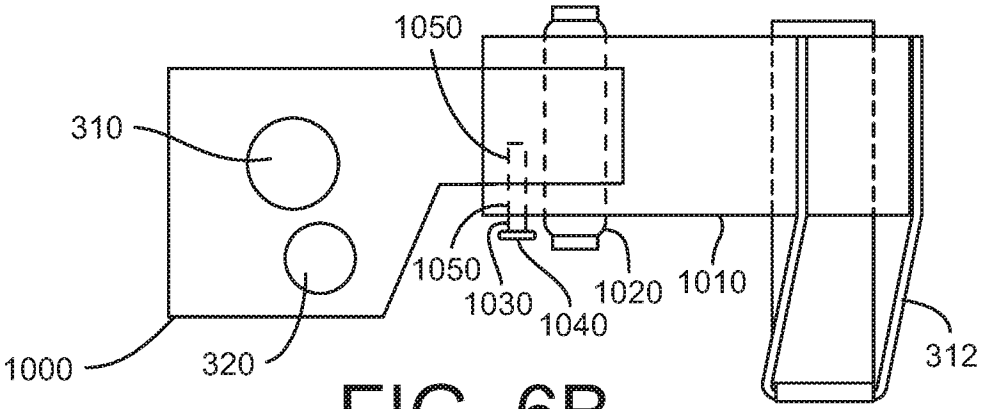
FIG. 6B is a non-limiting top view according to one aspect of the present disclosure.
Figure 6C:
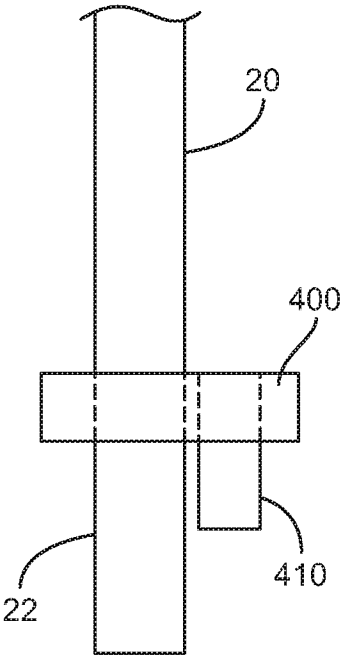
FIG. 6C is a non-limiting side view according to one aspect of the present disclosure.
Figure 7A:
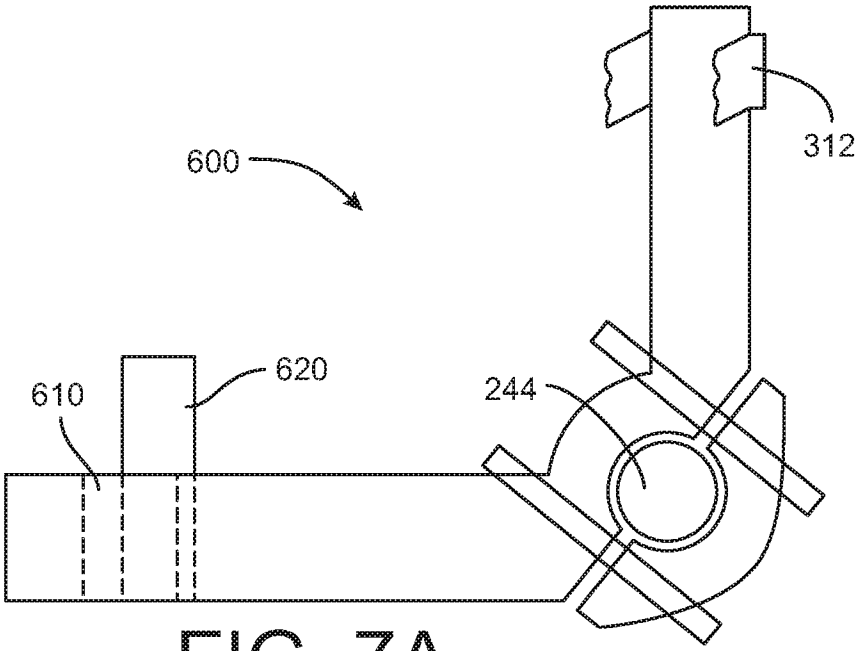
FIG. 7A is a non-limiting side view according to one aspect of the present disclosure.
Figure 7B:
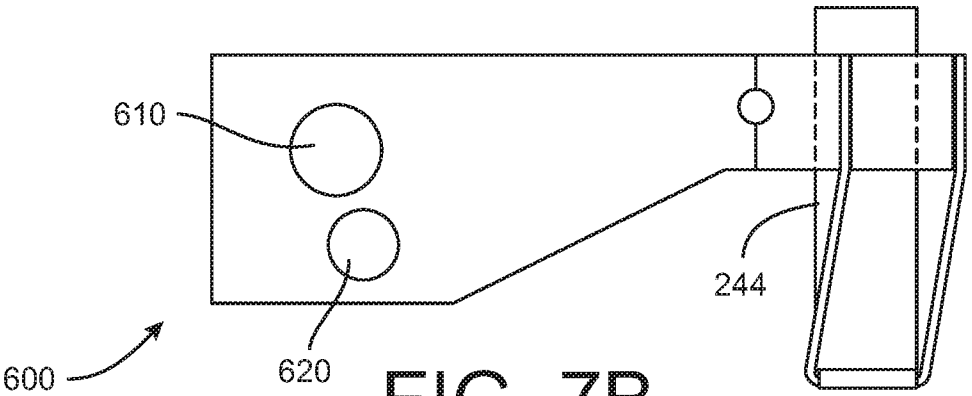
FIG. 7B is a non-limiting top view according to one aspect of the present disclosure.
Figure 7C:
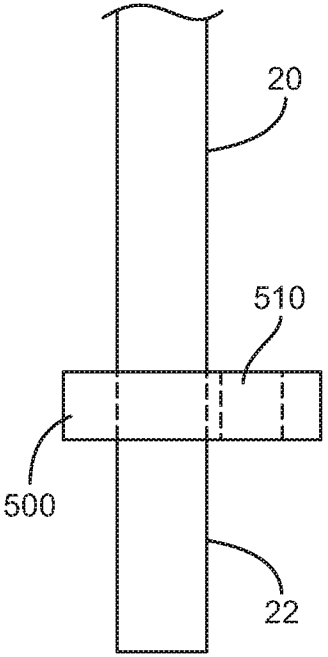
FIG. 7C is a non-limiting side view according to one aspect of the present disclosure.
Figure 8:
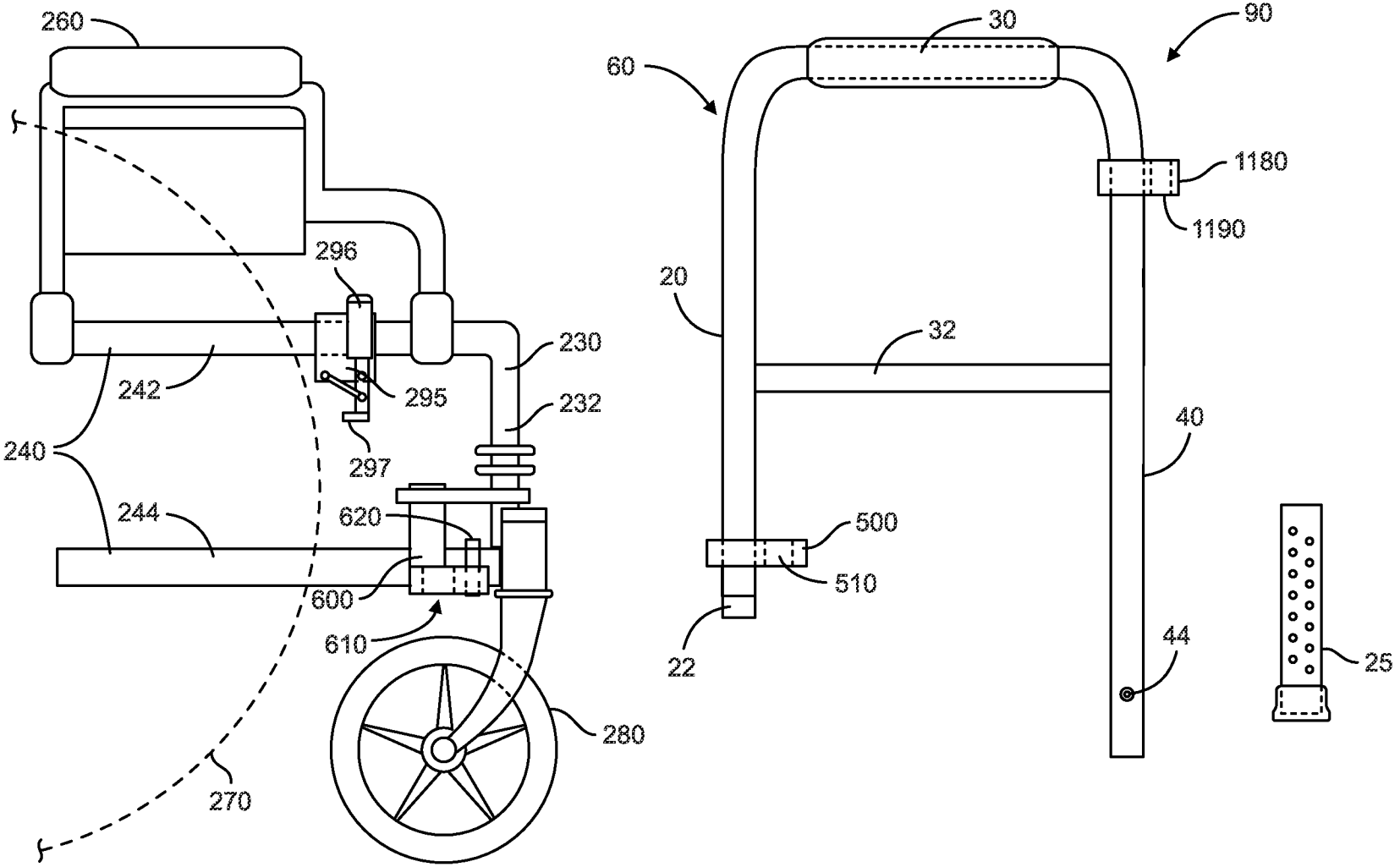
FIG. 8 is a non-limiting view according to one aspect of the present disclosure.

Referring to FIG. 3 and FIG. 4, adjustment of the floor-stop height extension 25 may be accomplished in any manner as is commonly known by one of ordinary skill. For example, floor-stop height extension 25 may include a series of holes 27 running along at least a portion of its length. Second leg 40 may include a spring button lock 44 that is biased away from the second leg when in a locked position. The spring button lock 44 is sized to mate with any of holes 27. When spring button lock 44 is depressed into second leg 40 and floor-stop height extension 25 is slid over second leg 40, spring button lock 44 will snap into hole 27; thereby, locking the floor-stop height extension 25 at a position corresponding to the location of the selected hole 27. If a different position is desired, floor-stop height extension 25 can be moved by depressing the spring button lock 44 to release it from hole 27 and sliding floor-stop extension 25 in the desired direction until spring button lock 44 enters a different hole 27 and locks in place.

Among other benefits, the adjustable feature allows the support 10 to be used with a multitude of wheelchairs of different dimensions. Also, when the floor-stop height extension 25 is slid further up second leg 40, it will eventually lose contact with the surface that it is contacting so as to allow support 10 to be more easily removed from wheelchair 200, as will be discussed in more detail below.

Referring to FIG. 3, in some embodiments, support 10 may also include at least one strut 32 arranged below top rail 30 and extending between first leg 20 and second leg 40. Strut 32 may be arranged parallel to top rail 30 or may be arranged non-parallel to top rail 30. Strut 32 provides additional strength and rigidity to support 10. In other embodiments not shown, strut 32 may include multiple struts that may either be parallel to top rail 30 or may be arranged non-parallel to top rail 30.

Now referring to FIGS. 3-6, device 1 further includes a bracket 300 constructed to be attached to wheelchair 200 and constructed to engage with the distal end 22 of first leg 20. Bracket 300 may be attached to wheelchair 200 at two attachment points. A first attachment point may include the lower horizontal member 244 of frame 220 of wheelchair 200. Bracket 300 includes a curved first channel 302 constructed to partially encircle lower horizontal member 244. An opposing bracket collar 304 includes a second channel 305 constructed to encircle the portion of the lower horizontal member 244 not encircled by channel 302, such that when the bracket collar 304 and bracket 300 are mounted on lower horizontal member 244, first channel 302 and second channel 305 together essentially encircle a portion of lower horizontal member 244. Bracket collar 304 may be attached to bracket 300 via any suitable means as would be understood by one of ordinary skill. For example, attachment means 306 may include screws, bolts and nuts or other suitable means.

One embodiment of the disclosure includes a second point of attachment of bracket 300 to wheelchair 200. For example, bracket 300 may be attached to one of the multiple vertical members 230. In one embodiment, bracket 300 may be attached to front vertical member 232 of frame 220 in any suitable manner as would be understood by one of ordinary skill. For example, bracket 300 may be attached to front vertical member 232 via strap 312. Strap 312 may extend from one side of bracket 300 to and around front vertical member 232 and extend from front vertical member 232 back to an opposing side of bracket 300. Strap 312 may be secured to bracket 300 via, for example, a bolt passing through the strap 312 located on each opposing side of bracket 300 as well as each of the respective opposing sides of bracket 300 and secured with a lock nut.

Referring to FIG. 3, FIG. 4 and FIGS. 6A-6C, one embodiment of the present disclosure includes a dual pin block 400 fixedly attached to the first leg 20 near the bottom 22. The bottom 22 of first leg 20 extends below dual pin block 400. Dual pin block 400 further includes a pin 410 that extends below the dual pin block 400 and parallel to first leg 20. Now, referring to FIGS. 6A-6C, bracket 300 in constructed to be complimentary to dual pin block 400. As such, bracket 300 further includes a first receiving feature 310 arranged along the top of bracket 300. The first receiving feature 310 may be a hole in the top of bracket 300 that extends into bracket 300 or may be a through hole that extends through bracket 300. In either case the first receiving feature 310 must be structured to receive the bottom 22 of first leg 20.

Bracket 300 further includes a second receiving feature 320 located in close proximity to the first receiving feature 310. Second receiving feature 320 may also be a hole that either extends partially through bracket 300 or completely through bracket 300. The second receiving feature 320 is structured to receive pin 410 of dual pin block 400. When support 10 is mounted on wheelchair 200 and bottom 22 of first leg 20 is located in the first receiving feature 310 and pin 410 of dual pin block 400 is located in the second receiving feature 320 of bracket 300, support 10 is located in the preferred position 2. In some embodiments, the first receiving feature 310 and the second receiving 320 feature may be located in rotatable member 1000 of bracket 300.

Now referring to FIGS. 7A-7C and FIG. 8, in another embodiment of the present disclosure, bracket 600 includes a receiving hole 610 that is constructed to receive bottom 22 of first leg 20 of support 10. The receiving hole 610 may extend partially into bracket 600 or may extend through bracket 600. Bracket 600 further includes a pin mount 620 arranged in close proximity to the receiving hole 610. Fixedly attached to first leg 20 near bottom 22 is pin block 500. Bottom 22 of first leg 20 of support 10 extends below pin block 500. Pin block 500 includes an opening 510 constructed to receive pin mount 620. When support 10 is mounted on bracket 600, the bottom 22 of first leg 20 is arranged in receiving hole 610 of bracket 600 and bracket pin mount 620 is arranged in opening 510 of pin block 500. When the bracket 600 is mounted on wheelchair 200, and support 10 is mounted on the bracket 600, the bracket receiving hole 610, pin mount 620 and pin block 500 are arranged so that the support 10 is in the preferred position 2 for exit from or entry onto the wheelchair 200.

Figure 9A:
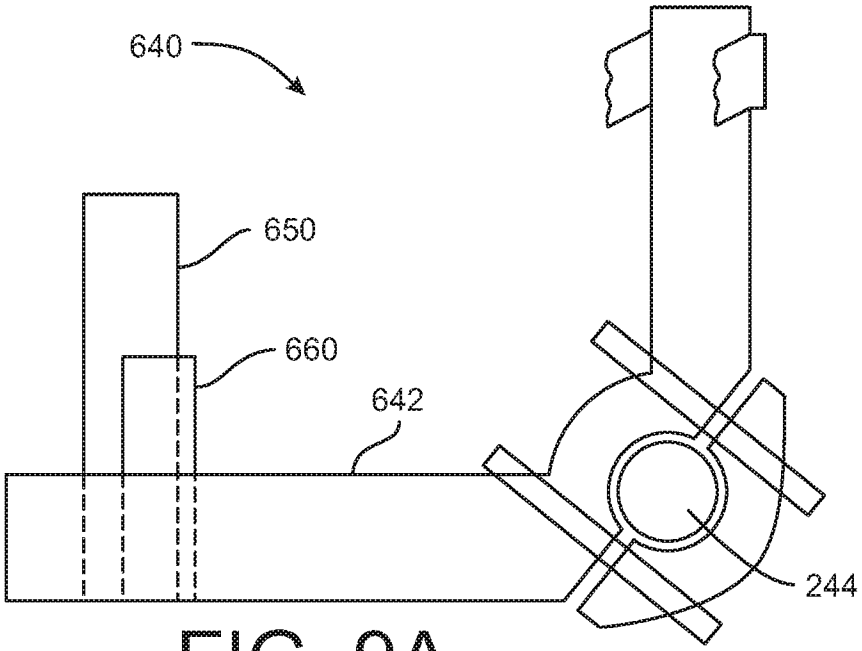
FIG. 9A is a non-limiting side view according to one aspect of the present disclosure.
Figure 9B:
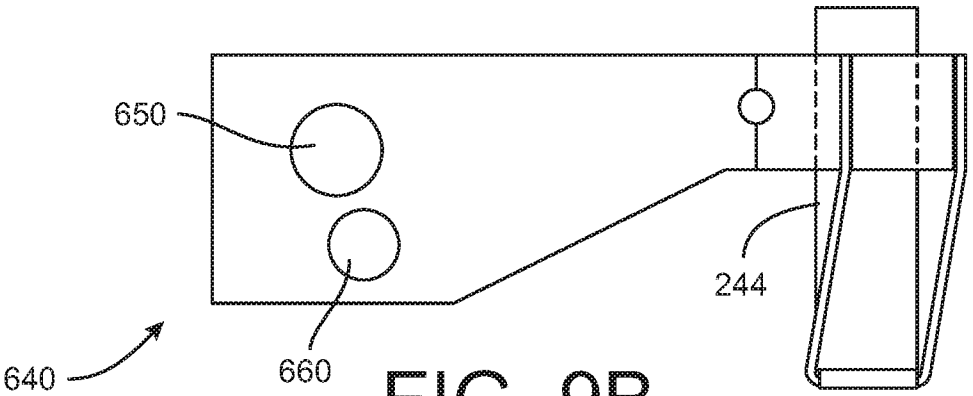
FIG. 9B is a non-limiting top view according to one aspect of the present disclosure.
Figure 9C:
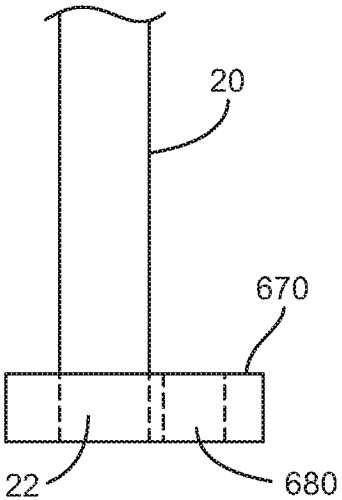
FIG. 9C is a non-limiting side view according to one aspect of the present disclosure.
Figure 10A:
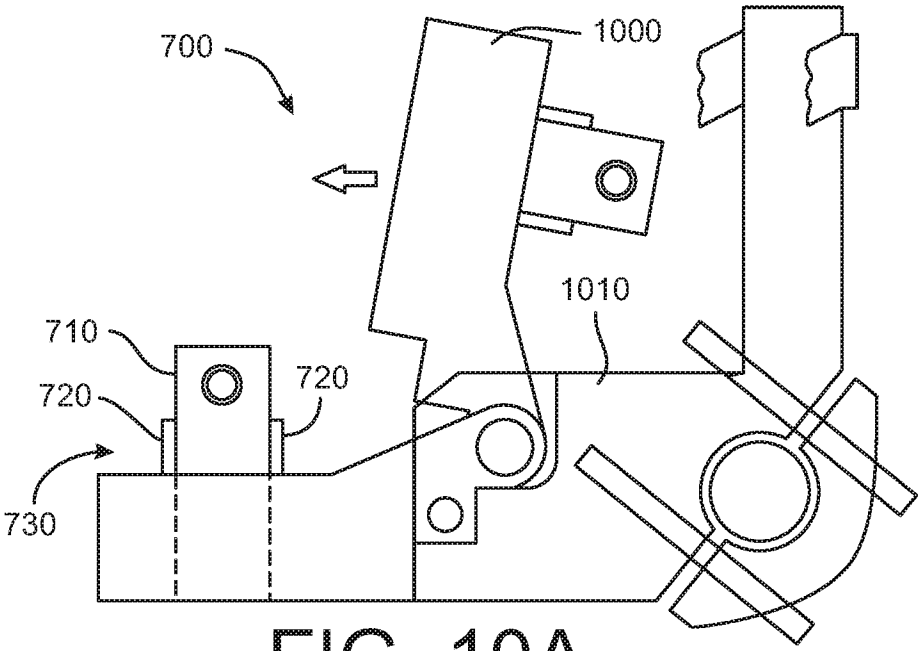
FIG. 10A is a non-limiting side view according to one aspect of the present disclosure.
Figure 10B:
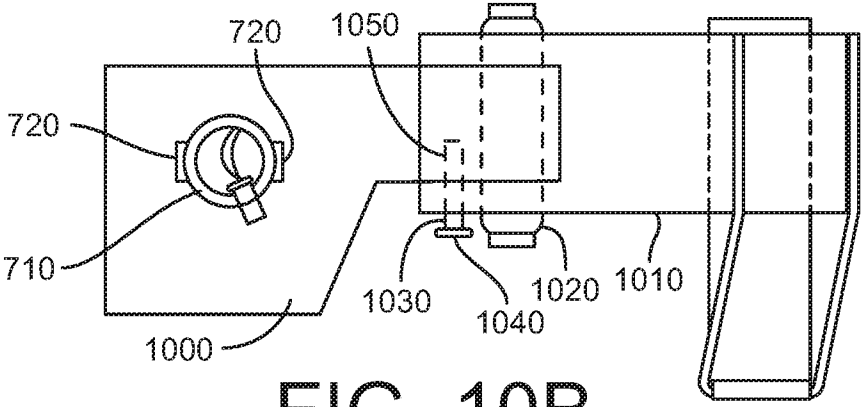
FIG. 10B is a non-limiting top view according to one aspect of the present disclosure.
Figure 10E:
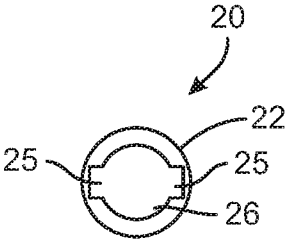
FIG. 10E is a non-limiting bottom view according to another aspect of the present disclosure.
Figure 10C:
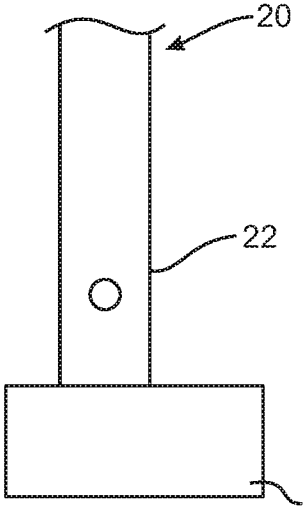
FIG. 10C is a non-limiting side view according to one aspect of the present disclosure.
Figure 10D:
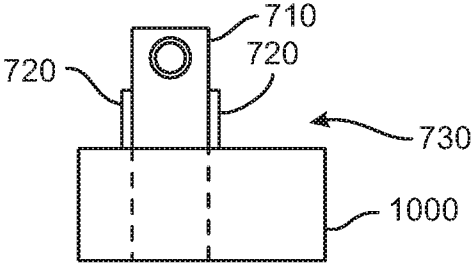
FIG. 10D is a non-limiting side view according to another aspect of the present disclosure.
Figure 11A:
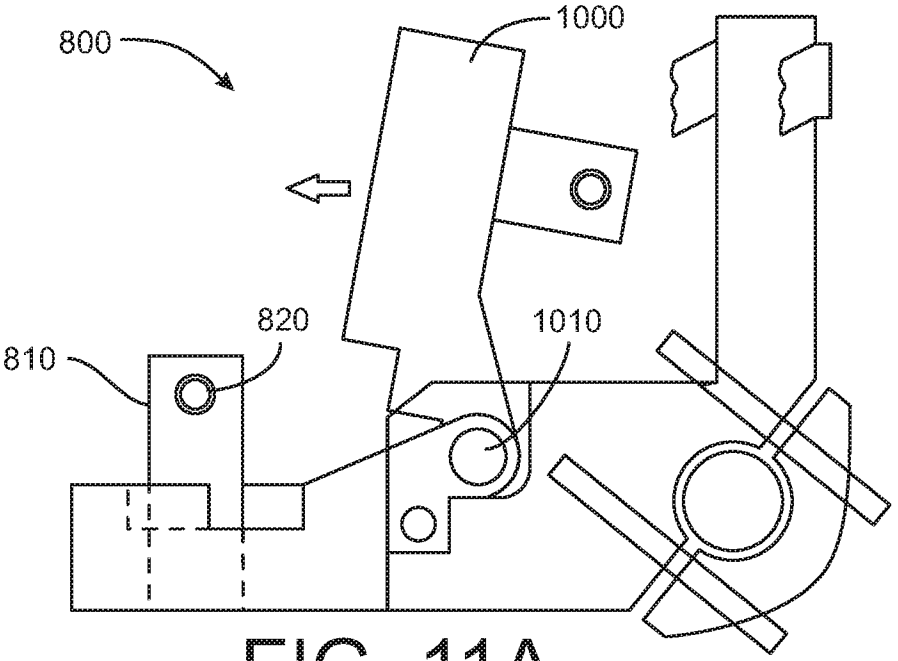
FIG. 11A is a non-limiting side view according to one aspect of the present disclosure.
Figure 11B:
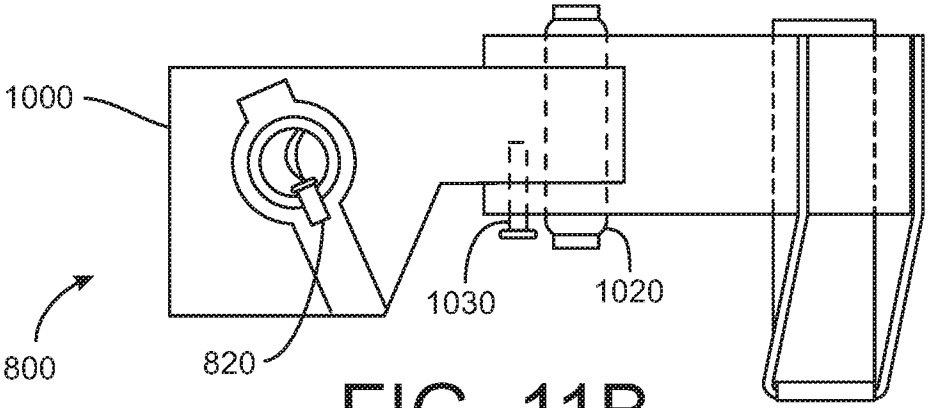
FIG. 11B is a non-limiting top view according to one aspect of the present disclosure.
Figure 11C:
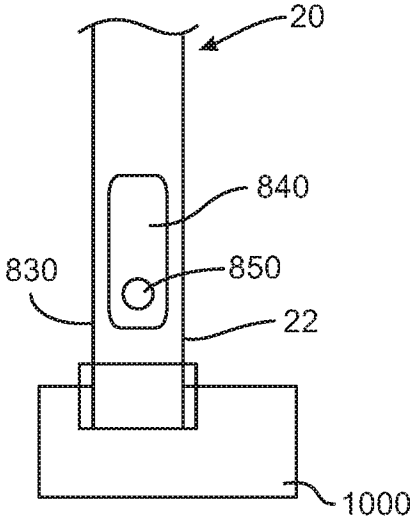
FIG. 11C is a non-limiting side view according to one aspect of the present disclosure.
Figure 11D:
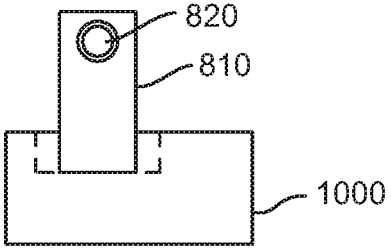
FIG. 11D is a non-limiting side view according to another aspect of the present disclosure.

Referring to FIGS. 9A-9C, another embodiment of the present disclosure is shown. Bracket 640 includes a first pin mount 650 that extends above the top surface 642 of bracket 640. First pin mount 650 is constructed to engage with first leg 20. In some embodiments, first pin mount 650 slides into the bottom 22 of first leg 20. A second pin mount 660 is arranged in close proximity to first pin mount 650 and extends above surface 642 parallel to first pin mount 650. Fixedly attached to first leg 20 of support 10 is pin block 670. Pin block 670 includes opening 680 that extends through pin block 670 and parallel to first leg 20 of support 10. Opening 680 is arranged to receive second pin mount 660 when first leg 20 is mounted on first pin mount 650. As seen in FIG. 9B, first pin 650 and second pin 660 are arranged to be off-set so that second pin 660 is located closer to horizontal member 244 of frame 220. This arrangement ensures that when the first leg 20 of support 10 is mounted on bracket 640, support 10 will be located in the preferred position 2 for exit from or entry onto wheelchair 200.

Referring now to FIGS. 10A-10E, another embodiment of the present disclosure is shown. The device 1 includes a bracket 700 having a pin mount 710 that extends above the top surface of bracket 700. If bracket 700 includes rotatable member 1000, pin mount 710 may be arranged to extend from the top surface of rotatable member 1000. Pin mount 710 is constructed to slidably engage with the bottom 22 of first leg 20 of support 10. Pin mount 710 includes a pair of opposing outer flutes 720 located on either side of pin mount 710 near a base 730 of pin mount 710. A pair of complimentary inner flutes 25 are located on the inside diameter 26 of first leg 20 near bottom 22. Essentially, the inner flutes 25 are slots that receive the outer flutes 720 of bracket 700 when support 10 is mounted on bracket 700. Moreover, the outer flutes 720 are positioned on pin mount 710 of bracket 700 and inner flutes 25 of first leg 20 are arranged to ensure that when bracket 700 is mounted on wheelchair 200 and support 10 is mounted on bracket 700, the outer flutes 720 and inner flutes 25 are engaged to ensure that the support 10 is arranged in the preferred position 2.

Referring now to FIGS. 11A-11D, another embodiment of the present disclosure is shown. Bracket 800 includes a pin mount 810 extending from the top surface of bracket 800. If bracket 800 includes rotatable member 1000, then pin mount 810 extends from the top surface of rotatable member 1000. Pin mount 810 is constructed to slidably engage with the bottom 22 of first leg 20 of support 10. Pin mount 800 further includes a push pin 820 constructed to engage with a complimentary push pin receiving hole 830 arranged on first leg 20. First leg 20 further includes a grasp release 840 constructed to engage with a push button 850 also located on first leg 20. Grasp release 840 is normally biased open. When first leg 20 is engaged on pin mount 810, push pin 820 enters the first leg 20 push pin receiving hole 830, thereby locking the support 10 onto bracket 800. The location of the push pin 820 on bracket 800 in relation to the location of the push pin receiving hole 830 on first leg 20 ensure that when the bracket 800 is mounted on the wheelchair 200 the support 10 will be in the preferred position 2.

To disengage the support 10 from the bracket 800, the grasp release 840 is depressed, thereby applying a force to the push button 850 which applies a corresponding force against the push pin 820 to push the push pin 820 out of the push pin receiving hole 830 allowing the first leg 20 to be disengaged from pin mount 810 and support 10 to be removed from bracket 800.

Figure 12A:
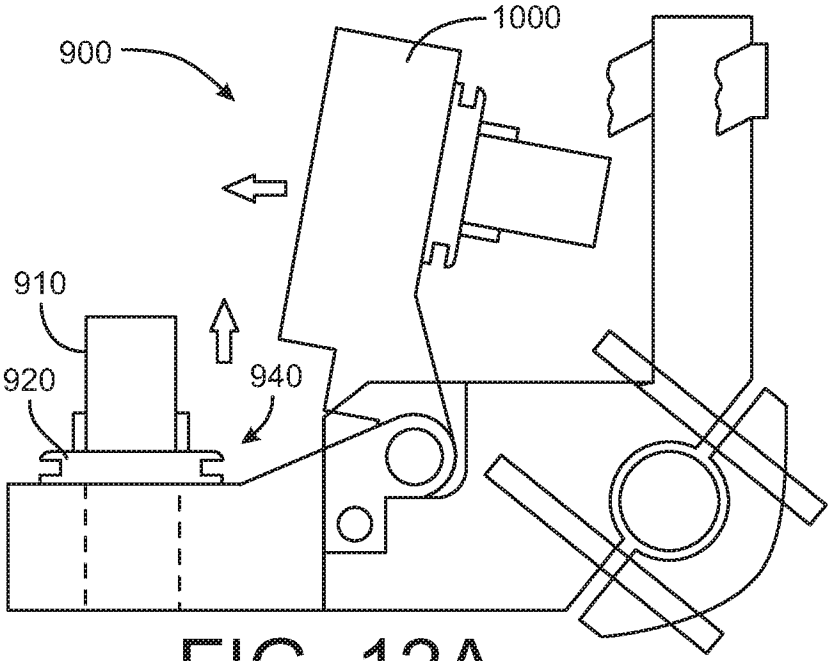
FIG. 12A is a non-limiting side view according to one aspect of the present disclosure.
Figure 12B:
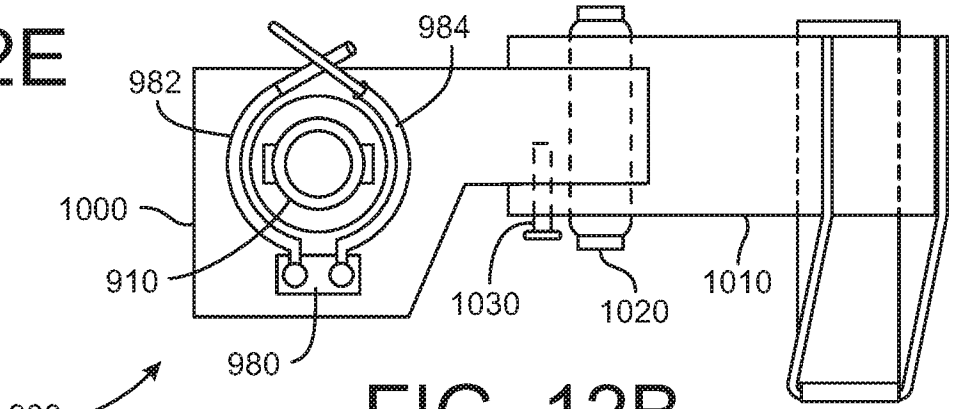
FIG. 12B is a non-limiting top view according to one aspect of the present disclosure.
Figure 12E:
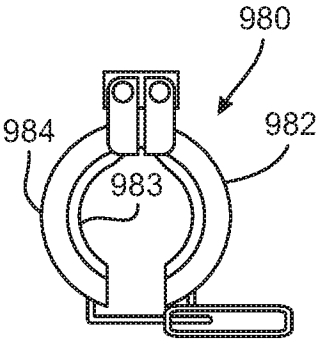
FIG. 12E is a non-limiting bottom view according to another aspect of the present disclosure.
Figure 12E:
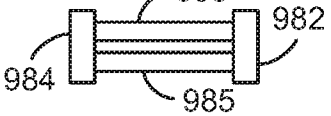
Figure 12C:
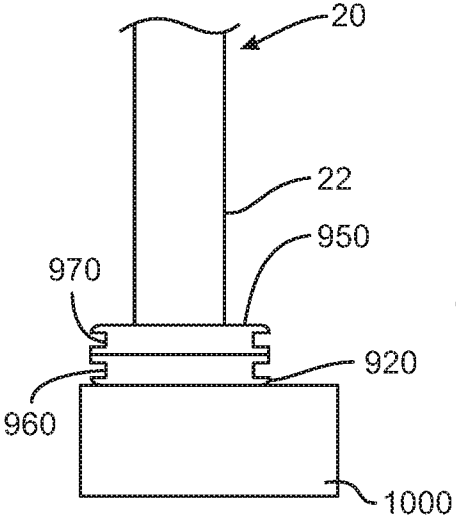
FIG. 12C is a non-limiting side view according to one aspect of the present disclosure.
Figure 12D:
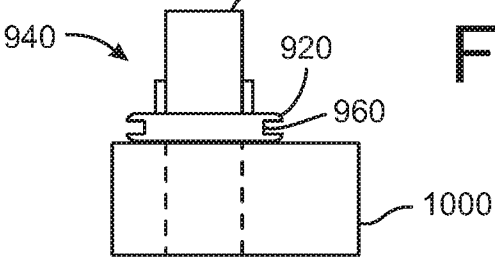
FIG. 12D is a non-limiting side view according to another aspect of the present disclosure.

Referring now to FIGS. 12A-12E, another embodiment of the present disclosure is shown. In this embodiment, bracket 900 includes pin mount 910 that extend above the top surface of bracket 900. If bracket 900 includes a rotatable member 1000, then pin mount 910 may be arranged on rotatable member 1000 and extend above the top surface of rotatable member 1000. Pin mount 910 is constructed to slidably engage with the bottom 22 of first leg 20 of support 10. The pin mount 910 further includes a first collar 920 arranged on a base 940 of pin mount 910. The first collar 920 defines a first circumferential channel 960 that wraps around the circumference of base 940. A second collar 950 is arranged around the circumference of the bottom 22 of first leg 20 of support 10. The second collar 950 defines a second circumferential channel 970. As seen in FIG. 12C, when the first leg 20 of support 10 is mounted on pin mount 910 of rotatable member 1000 of bracket 900, the first collar 920 of pin mount 910 abuts the second collar 950 arranged on the bottom 22 of first leg 20.

The bracket 900 further includes a swivel clamp lock 980 that is fixedly attached to the bracket 900 near pin mount 910. Swivel clamp lock 980 includes opposing curved members 982 and 984 that include mating members 983 and 985 that are constructed to seat into first circumferential channel 960 and second circumferential channel 970. When the first leg is mounted on bracket 900 and the first collar 920 is abutted against the second collar 950, curved members 982 and 984 of swivel clamp lock 980 may be wrapped around the first collar 920 and second collar 950 and mating members 983 and 985 are seated into first circumferential channel 960 and second circumferential channel 970 to lock the first leg 20 onto bracket 900; thereby, securing the support 10 to wheelchair 200.

Now referring to FIG. 6 and FIG. 10, for example, each of the embodiments of the bracket described herein may include a rotatable member 1000 that is rotatable up and toward the frame 220 of wheelchair 200. Rotatable member 1000 is attached to a second member 1010 that is arranged to be secured to the frame 220 as previously discussed herein. Rotatable member 1000 and second member 1010 are connected via a hinge 1020. Typically, features located on the bracket that allow the first leg 20 to be mounted on the bracket, such as a pin mount are arranged on rotatable member 1000. When the bracket is mounted on wheelchair 200 and support 10 is not mounted on the bracket, rotatable member 1000 may be rotated up and toward frame 220. This rotated position brings the rotatable member closer to frame 220 of wheelchair 200 into a more storage like and less obstructive position.

The bracket may include a locking mechanism 1030 to allow for locking and unlocking the rotatable member 1000 in the down position, which is the position rotatable member 1000 is in when the support 10 is mounted on the bracket. The locking mechanism 1030 may include a pull pin 1040 that is mounted in a pull pin mounting hole 1050 that begins in a portion of the second member 1010 near hinge 1020 and extends into rotatable member 1000. The pull pin 1040 may be spring loaded. When the rotatable member is in the down position, the spring loaded pull pin 1040 is biased to inserted in pull pin mounting hole 1050 and extend into rotatable member 1000, thus locking the rotatable member 1000 in the down position so that the support 10 can be mounted on the bracket. When the bracket is not in use, rotatable member 1000, may be unlocked by pulling the pull pin 1040 out of the pull pin mounting hole 1050 until it is no longer seated in rotatable member 1000 and then rotating the rotatable member 1000 up toward frame 220.

Referring now to FIGS. 1-4, embodiments of the present disclosure may include sufficient hand clearance to allow easy access to a brake designed to apply a braking force to the rear wheel 270 of the wheelchair 200. Such a brake is typically mounted on the frame 220 of the wheelchair. For example, when the support 10 is mounted on bracket 300, the distance between the inside of support 10 to the brake handle 296 may be approximately 2 inches or more. The distance from the brake handle 296 to the outside of the wheelchair frame 220 may be approximately 2.5 inches or more. This provides approximately 4.5 inches or more of clearance between the inside of the support 10 to the outside of the frame 220. This distance provides sufficient hand clearance for an occupant of the wheelchair to safely and comfortably operate the wheelchair brake.

Figure 13B:
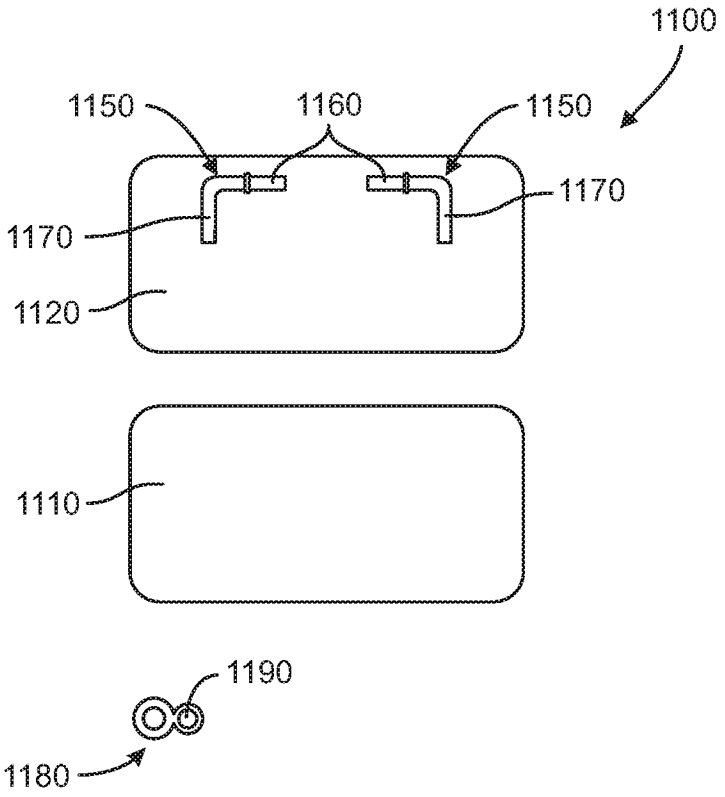
FIG. 13B is a non-limiting view according to one aspect of the present disclosure.
Figure 13A:
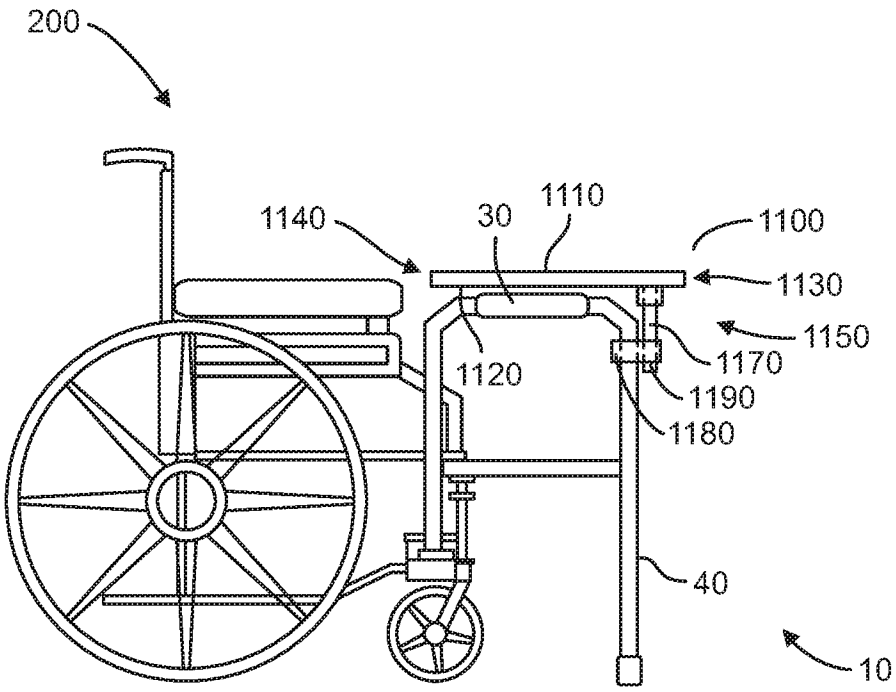
FIG. 13A is a non-limiting side view according to one aspect of the present disclosure.

Now referring to FIG. 13, embodiments of the present disclosure may include a removable table 1100 that is constructed to mounted on a pair of opposing supports 10 that are mounted on wheelchair 200. Table 1100 includes a top 1110, a bottom 1120, a front 1130 and a back 1140. Attached to the bottom 1120 of table 1100 are opposing table mounts 1150 each constructed to be mounted on respective opposing supports 10. Opposing table mounts 1150 may include a first section 1160 constructed to be attached to the bottom 1120 of table 1100. Opposing table mounts 1150 further include a second section 1170 that is perpendicular to first section 1160. Opposing table mounts 1150 are constructed to allow second section 1170 to be rotated away from the bottom 1120 when first section 1160 is mounted to the bottom 1120.

Fixedly attached to the second legs 40 of respective opposing supports 10 are respective table attachment couplings 1180. Table attachment coupling 1180 includes a table mounting opening 1190 that is constructed to receive second section 1170 of respective table mounts 1150 when table 1100 is mounted on said respective supports 10. Table attachment couplings 1180 are positioned on second legs 40, so that when the table is mounted on supports 10 via table attachment couplings 1180, the table will be position at or near the height of the respective top rails 30 of supports 10.

It should be understood, that relative positional terms such as, "upper," "lower," "above," "below," "front," "back" and the like, are with reference to the normal operational position of the device disclosed herein with respect to its normal intended use in connection with a wheelchair. Such positional terms should not be considered otherwise limiting.

The present disclosure has been described in an illustrative manner. It is to be understood that the terminology that has been employed herein is intended to be in the nature of words of description rather than word of limitation. While there have been described herein what are considered to be exemplary embodiments of the present disclosure, other modifications of the disclosure shall be apparent to those skilled in the art from the teachings herein and, it is, therefore, desired to be secured in the appended claims all such modification as fall within the true spirit and scope of the disclosure.

I claim:

1. A device for assisting entry and exit from a wheelchair comprising:

a support having a horizontal top rail, the top rail having a first end and a second end;

a first leg depending downwardly from the first end;

a second leg arranged opposite and parallel to the first leg, the second leg depending downwardly from the second end;

a bracket attached to the wheelchair, the wheelchair comprising a frame having at least one horizontal member and at least one vertical member, said bracket attached to the at least one horizontal member and the at least one vertical member, the bracket constructed to engage with a bottom of the first leg such that when the bracket and bottom of the first leg are engaged, the device may be used to enter or exit the wheelchair.

2. The device of claim 1 further comprising at least one support strut arranged below the top rail and extending between the first leg and the second leg.

3. The device of claim 1 wherein a section of the second leg is retractable.

4. The device of claim 1 further comprising a dual pin block fixedly attached to the first leg near the bottom, such that the bottom of the first leg extends below the dual pin block, the dual pin block further including a pin extending below the dual pin block and parallel to the first leg, the bracket further including a first receiving feature and a second receiving feature, the first receiving feature constructed to receive the bottom of the first leg and the second receiving feature constructed to receive the pin, such that when the support is mounted on the bracket, the support is locked into a preferred position for exit from the wheelchair.

5. The device of claim 1 further comprising a pin block fixedly attached to the first leg near the bottom, such that the bottom of the first leg extends below the pin block, the pin block further including an opening arranged next to and parallel to the first leg, the bracket further including a receiving hole and a pin mount arranged near to the receiving hole, such that when the support is mounted on the bracket, the first leg is engaged in the bracket receiving hole and the pin mount is engaged in the opening.

6. The device of claim 1 wherein the bracket includes a pin mount constructed to slidably engage with the bottom of the first leg, the pin mount including at least one outer flute constructed to engage with at least one inner flute located in the bottom of the first leg, such that when the bottom of the first leg and pin mount are slidably engaged, the at least one outer flute engages the at least one inner flute thereby locking the device in a preferred position.

7. The device of claim 1 wherein the bracket includes a pin mount constructed to slidably engage with the bottom of the first leg the pin mount including a push pin constructed to engage with a push pin receiving hole located on the first leg, the first leg further including a grasp release that is normally biased open and constructed to actuate a push button located on the first leg when a grasping force is applied to the grasp release, such that when the first leg is engaged with the pin mount and the grasp release is forced against the push button, the push button acts against the push pin to allow the first leg to be disengaged from the pin mount.

8. The device of claim 1 wherein the bracket includes a pin mount constructed to enter into the bottom of the first leg, the pin mount further including a first collar defining a first circumferential channel located near a base of the pin mount, the first leg further including a second collar defining a second circumferential channel located along the bottom of the first leg, the bracket further including a swivel clamp lock located near the base of the pin mount wherein when the first leg is arranged on the pin mount the second collar is butted against the first collar and the swivel clamp may be used to engage the second collar and the first collar thereby locking the first leg to the pin mount.

9. The device of claim 1 wherein the bracket includes a first member rotatably connected to a second member wherein the first member is constructed to engage with the bottom of the first leg and the second member is constructed to be mounted on the frame.

10. A wheelchair in combination with a device for use in exiting and entering a wheelchair, the device comprising:

a support having a horizontal top rail, the top rail having a first end and a second end;

a first leg depending downwardly from the first end;

a second leg arranged opposite and parallel to the first leg, the second leg depending downwardly from the second end;

a dual pin block fixedly attached to the first leg near a bottom of the first leg, such that the bottom of the first leg extends below the dual pin block, the dual pin block further including a pin extending below the dual pin block and parallel to the first leg;

a bracket attached to the wheelchair, the bracket including a first receiving feature and a second receiving feature, the first receiving feature constructed to receive the bottom of the first leg and the second receiving feature constructed to receive the pin, such that when the support is mounted on the bracket, the support is locked into a preferred position for exit from the wheelchair.

11. The device of claim 10 further comprising at least one support strut arranged below the top rail and extending between the first leg and the second leg.

12. The device of claim 10 wherein a section of the second leg is adjustable.

13. The device of claim 10 wherein the wheelchair includes a frame having at least one horizontal member and at least one vertical member and wherein said bracket is attached to the at least one horizontal member and the at least one vertical member.

14. The device of claim 10 further including a table, the table constructed to be removably mounted on the support.

15. The device of claim 10 wherein the bracket includes a first member rotatably connected to a second member via a hinge, wherein the first member is constructed to engage with the bottom of the first leg and the second member is constructed to be mounted on the frame.

* * * * *